US010384101B2

(12) United States Patent
Valbousquet

(10) Patent No.: US 10,384,101 B2
(45) Date of Patent: Aug. 20, 2019

(54) TENNIS RACKET

(71) Applicant: BABOLAT VS, Lyons (FR)

(72) Inventor: Emilie Valbousquet, Lyons (FR)

(73) Assignee: BABOLAT VS, Lyons (FR)

( * ) Notice: Subject to any disclaimer, the term of this patent is extended or adjusted under 35 U.S.C. 154(b) by 0 days.

(21) Appl. No.: 15/563,167

(22) PCT Filed: Mar. 31, 2016

(86) PCT No.: PCT/EP2016/057049
§ 371 (c)(1),
(2) Date: Sep. 29, 2017

(87) PCT Pub. No.: WO2016/156485
PCT Pub. Date: Oct. 6, 2016

(65) Prior Publication Data

US 2018/0078828 A1 Mar. 22, 2018

(30) Foreign Application Priority Data

Apr. 1, 2015 (FR) ..... 15 52798

(51) Int. Cl.
*A63B 49/02* (2015.01)
*A63B 49/14* (2015.01)
(Continued)

(52) U.S. Cl.
CPC ..... *A63B 49/02* (2013.01); *A63B 49/022* (2015.10); *A63B 49/038* (2015.10); *A63B 49/14* (2013.01); *A63B 51/10* (2013.01); *A63B 2225/01* (2013.01)

(58) Field of Classification Search
CPC ..... A63B 49/00; A63B 49/02; A63B 49/022; A63B 49/038; A63B 49/14; A63B 51/00; A63B 51/10; A63B 2225/01
See application file for complete search history.

(56) References Cited

U.S. PATENT DOCUMENTS 4,221,383 A * 9/1980 Cappelli ..... A63B 49/08 473/526
4,913,434 A * 4/1990 Fischer ..... A63B 49/10 473/535
(Continued)

FOREIGN PATENT DOCUMENTS

CA 2 076 229 A1 2/1994
EP 0 714 681 A1 6/1996
(Continued)

OTHER PUBLICATIONS

International Search Report, dated Jun. 8, 2016, from corresponding PCT/EP2016/057049 application.

*Primary Examiner* — Raleigh W Chiu
(74) *Attorney, Agent, or Firm* — Young & Thompson

(57) ABSTRACT

Disclosed is a tennis racket including: an oval frame adapted to support a latticework, and through-bands for the strands of latticework cord, each band being received in an outer housing in the frame and including through-tubes for the strands, the tubes being inserted in the direction of the interior of the frame in through-holes provided in the frame. Each band is arranged flush with the outer edge of the cross-section of the frame, and an outer shell of the cross-section of the frame is essentially diamond shaped.

12 Claims, 3 Drawing Sheets

Figure 1:
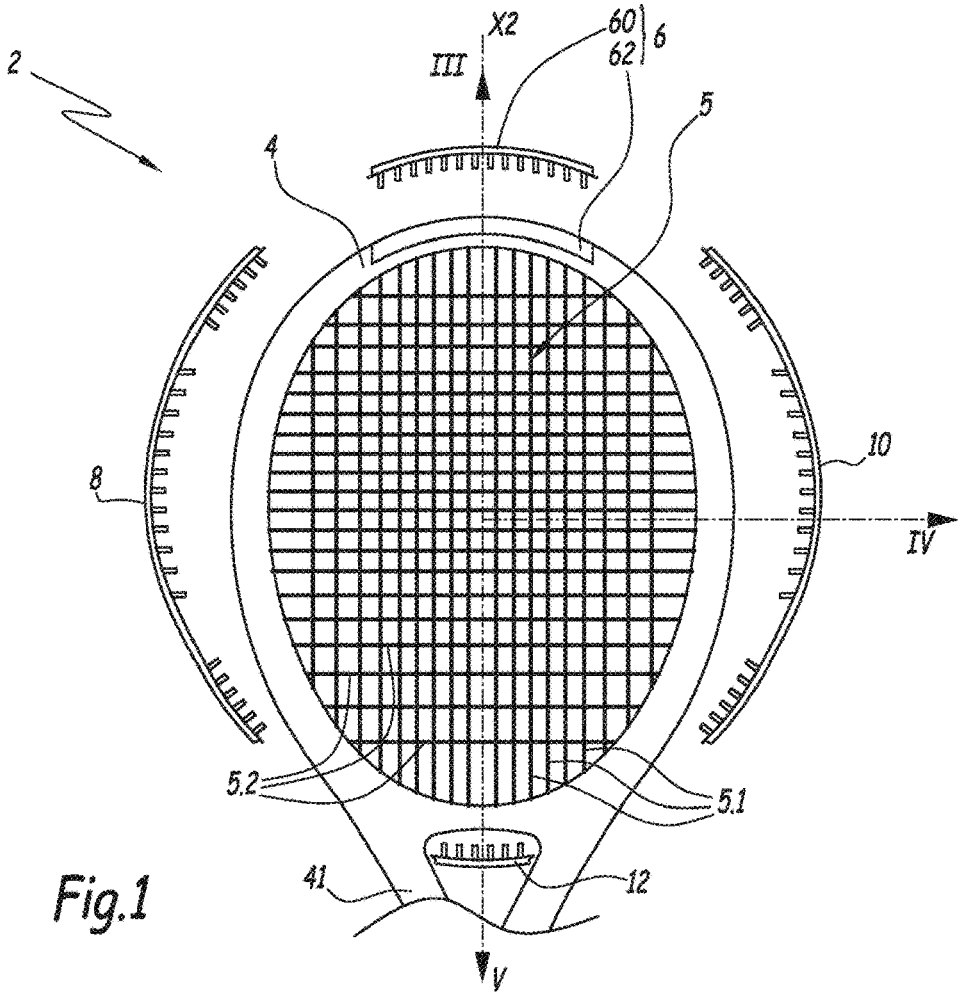

(51) Int. Cl.

| | |
|---|---|
| ***A63B 51/10*** | (2015.01) |
| ***A63B 49/022*** | (2015.01) |
| ***A63B 49/038*** | (2015.01) |

(56) References Cited

U.S. PATENT DOCUMENTS

| | | | | | |
|---|---|---|---|---|---|
| 5,037,098 | A * | 8/1991 | Davis | A63B 49/02 | 473/521 |
| 5,102,132 | A | 4/1992 | Chen | | |
| 5,332,213 | A * | 7/1994 | Klose | A63B 49/022 | 473/522 |
| 5,368,297 | A | 11/1994 | Liu | | |
| 5,409,215 | A | 4/1995 | You | | |
| 5,833,560 | A * | 11/1998 | Davis | A63B 49/00 | 473/537 |
| 5,913,740 | A * | 6/1999 | Miklos | A63B 49/02 | 473/537 |
| 5,944,624 | A * | 8/1999 | Davis | A63B 49/022 | 473/522 |
| 6,050,909 | A * | 4/2000 | Severa | A63B 49/022 | 473/524 |
| 6,447,412 | B1 * | 9/2002 | Filippini | A63B 49/10 | 473/524 |
| 6,527,656 | B1 * | 3/2003 | Cheng | A63B 49/022 | 473/539 |
| 6,540,626 | B1 * | 4/2003 | Tsai | A63B 49/02 | 473/540 |
| 7,371,197 | B1 * | 5/2008 | Yu | A63B 49/022 | 473/521 |
| 7,887,444 | B1 * | 2/2011 | Severa | A63B 49/10 | 473/539 |
| 2004/0152544 | A1 * | 8/2004 | Lammer | A63B 49/02 | 473/520 |
| 2006/0172827 | A1 * | 8/2006 | Soekahar | A63B 49/022 | 473/520 |
| 2006/0205543 | A1 * | 9/2006 | Schwenger | A63B 49/02 | 473/539 |
| 2008/0274842 | A1 * | 11/2008 | Sledge | A63B 49/02 | 473/524 |
| 2012/0077630 | A1 * | 3/2012 | Bothwell | A63B 49/002 | 473/539 |
| 2013/0172134 | A1 * | 7/2013 | Yamamoto | A63B 49/02 | 473/537 |
| 2013/0316858 | A1 * | 11/2013 | Yu | A63B 60/42 | 473/519 |
| 2014/0296006 | A1 | 10/2014 | Bothwell | | |
| 2016/0199702 | A1 * | 7/2016 | Bothwell | A63B 71/0622 | 473/524 |
| 2017/0173407 | A1 * | 6/2017 | Ogawa | A63B 51/10 | |
| 2018/0028875 | A1 * | 2/2018 | Araya | A63B 51/00 | |
| 2018/0078828 | A1 * | 3/2018 | Valbousquet | A63B 49/02 | |

FOREIGN PATENT DOCUMENTS

| | | | |
|---|---|---|---|
| EP | 2 283 903 | A1 | 2/2011 |
| JP | 2000 300698 | A | 10/2000 |
| WO | 94/00203 | A1 | 1/1994 |

* cited by examiner

TENNIS RACKET

The invention relates to a tennis racket, in particular a so-called aerodynamic tennis racket.

In the field of tennis rackets, one area of development is the improved aerodynamics of rackets to reduce the drag exerted by the surrounding air during shots. For a constant striking force, a racket moves through the air more quickly when it has an aerodynamic shape.

Many rackets considered to be aerodynamic exist. For example, CA-A-2,076,229 discloses a tennis racket comprising an oval frame suitable for supporting a lattice-work and a bumper. This bumper is received in a housing at the apex of the frame and includes through-tubes for main strings of the lattice-work. These tubes are inserted toward the inside of the frame in through-holes arranged in the latter. The receiving housing of the bumper is hollow such that the bumper does not add an excess thickness relative to the rest of the frame of the racket.

However, a tennis racket generally comprises other bands for the passage of the main strings or cross strings. These bands may be better known as grommets and are arranged on the sides of the frame and at the Y-shaped part, or yoke. They are generally each inserted into a hollow housing on the periphery of the frame. In practice, these bands are arranged withdrawn relative to the outer edge of the frame, such that there is a surface discontinuity between the band and the frame, which increases the drag forces applied on the racket. Furthermore, as shown in FIG. 10 of CA-A2 076 229 the frame has an oval section, which does not favor optimal aerodynamic behavior for all tennis shots.

Additionally, WO-A-94/00203 discloses a tennis racket comprising a frame whose outer surface is cellular, like a golf ball, to improve the aerodynamic behavior of the racket. The formation of cells, i.e., depressions, on the outer surface of the frame alters the dynamic behavior of the racket and may reduce the drag forces exerted by the surrounding air.

Lastly, EP-A-0,714,681 discloses a tennis racket that includes a frame having a reduced apical cross-section with a globally circular shape. This particular geometry of the apical cross-section of the frame makes it possible to improve the aerodynamic behavior of the racket.

One main objective of the invention is to propose a still more aerodynamic tennis racket than the rackets of the prior art.

To that end, the invention relates to a tennis racket, comprising an oval frame adapted to support a lattice-work, and through-bands for the strands of lattice-work cord, each band being received in an outer housing in the frame and comprising through-tubes for the strands, said tubes being inserted in the direction of the interior of the frame, in through-holes provided in the frame. Each band is arranged flush with the outer edge of the cross-section of the frame, and an outer shell of the cross-section of the frame is essentially diamond-shaped.

Owing to the invention, the assembly on the racket frame of the through-bands for the main strings or cross strings of the lattice-work does not cause any surface discontinuity relative to the frame, which makes it possible to obtain, combined with the diamond-shaped chosen for the section of the frame, optimal aerodynamic behavior for all tennis shots (forehand, backhand, serve). The drag forces applied on the racket are lower, such that tennis players exert less energy to move the racket at a given speed, and they can increase their striking speed, in particular when serving, where the generated speeds are maximal.

According to advantageous, but optional aspects of the invention, a tennis racket may comprise one or more of the following features, considered in any technically allowable combination:

- The tubes protrude in the direction of the interior of the frame by a distance smaller than 2.5 mm.
- At least one through-band for the strands of cord has two parts.
- The band arranged at the apex of the racket has two parts.
- The band arranged at the apex of the racket comprises a coating and a comb covering a central part of the coating.
- The tubes belong to the comb and in that the coating defines through-orifices of the tubes.
- The two parts of each two-part band have flush outer surfaces.
- At least some of the tubes define oblong holes, inside which the cord strands can move.
- The cord strands have main strings and cross strings, while the through-tubes of the main strings define oblong holes, with the largest dimension of the holes parallel to the plane of the lattice-work and perpendicular to the main strings.
- The diamond shape of the outer shell of the cross-section of the frame is stretched in a direction perpendicular to the lattice-work.

Figure 2:
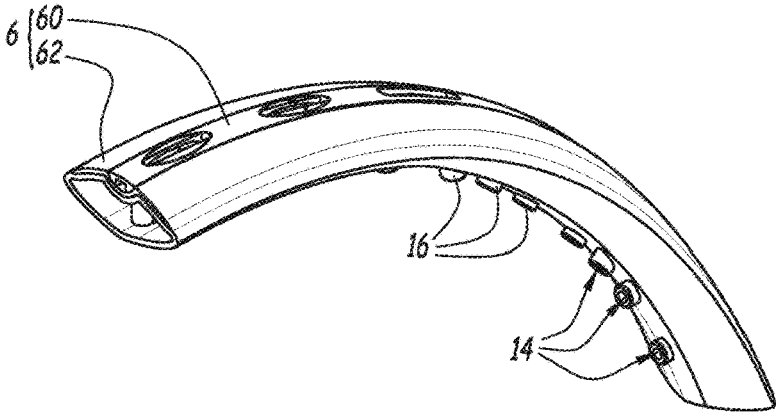
Figure 3:
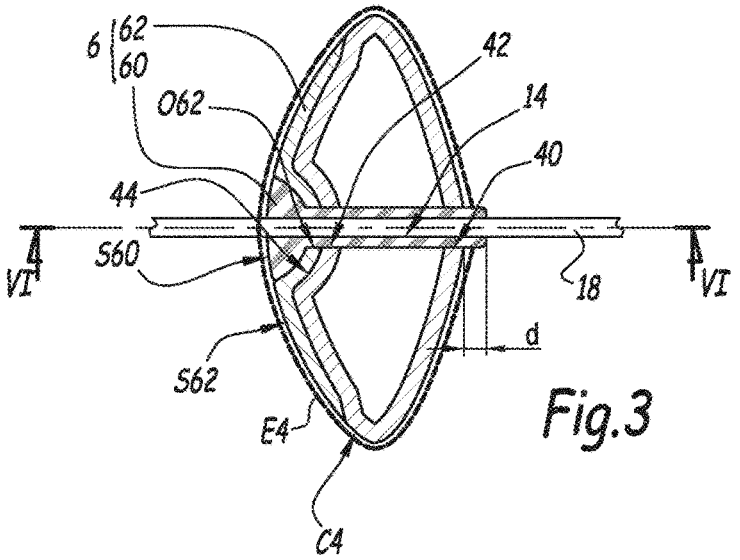
Figure 4:
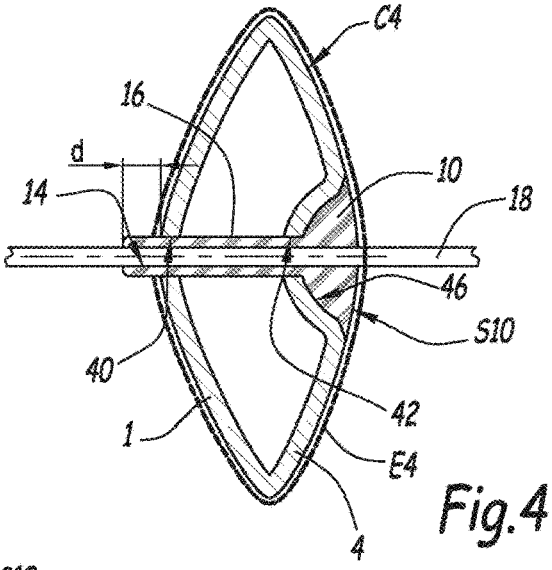
Figure 5:
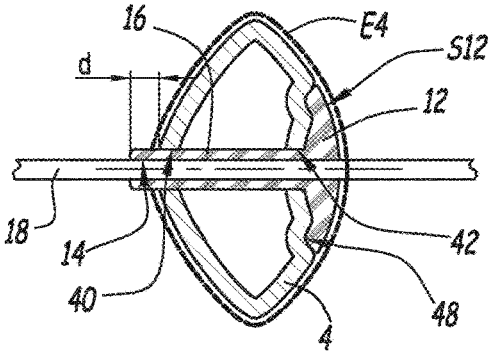
Figure 6:
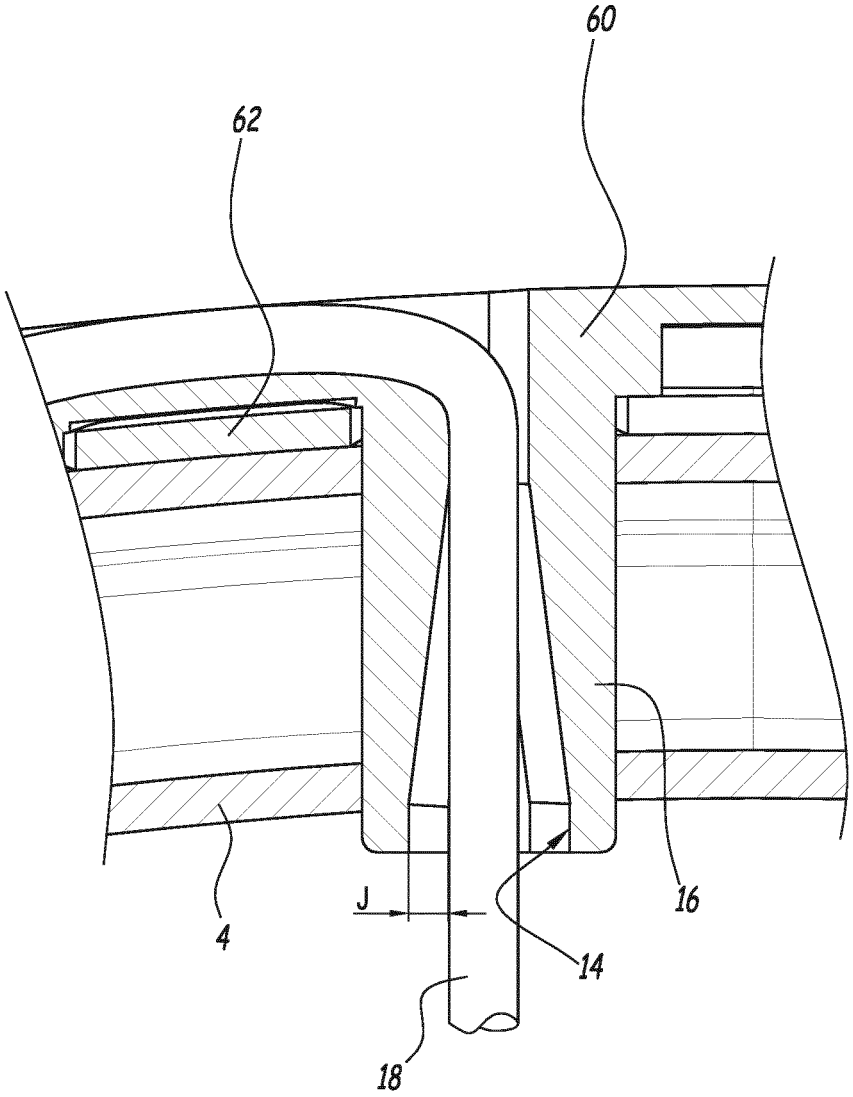

The invention and other advantages thereof will appear more clearly in light of one embodiment of a tennis racket according to its principle, provided as an example and done in reference to the appended drawings, in which:

FIG. 1 is a front and exploded view of a tennis racket according to the invention, in which the handle has been omitted, FIG. 2 is a perspective view of the apical portion of the frame of the racket of FIG. 1, FIGS. 3, 4 and 5 are cross-sections of the racket along lines III, IV and V shown in FIG. 1, in the assembled configuration of the racket, and FIG. 6 is an enlarged cross-sectional view along line VI-VI in FIG. 3.

FIG. 1 shows a tennis racket 2, extending along a longitudinal axis X2. In this figure, the handle of the racket 2, which normally extends parallel to the axis X2 and downward, is not shown. The racket 2 comprises an oval frame 4, generally made from carbon, adapted to support a lattice-work 5. The lattice-work 5 comprises a cord that goes back and forth in the longitudinal direction and a cord that goes back and forth in the transverse direction. Reference 5.1 denotes longitudinal cord strands and 5.2 denotes transverse cord strands. The strands 5.1 are called main strings, and the strands 5.2 are called cross strings. As shown in FIGS. 2 to 5, the frame 4 is hollow and an outer shell E4 of the cross-section of the frame is essentially diamond-shaped with rounded corners. The outer shell E4 is shown in thick solid lines in FIGS. 3 to 5.

In the present description, the location of the sections of the frame 4, illustrated in FIGS. 3 to 5, is for example done relative to a clock dial, applied to the configuration of FIG. 1. For example, the cross-section at 12 o'clock corresponds to the cross-section at the apex of the racket 2, i.e., the cross-section along line III in FIG. 1.

The cross-section of the frame 4 is not homogeneous over the entire periphery of the frame. Indeed, like in FIGS. 3 to 5, the outer shell E4 of the cross-section of the frame 4 at six o'clock is smaller than that of the cross-section of the frame at twelve o'clock or three o'clock. The diamond shape of the outer shell E4 of the cross-section of the frame 4 is stretched in a direction perpendicular to the lattice-work 5, i.e., perpendicular to the plane of FIG. 1.

The apex of the frame 4 is defined as the part arranged opposite the handle along the axis X2. The frame 4 comprises, at its apex, a housing 44 receiving a bumper 6. The bumper 6 has a dual function: it protects the main strings 5.1 of the lattice-work 5 from contact with the carbon frame 4, and protects the carbon frame 4 from impacts. The bumper 6 has two parts. It comprises a plastic coating 62, which covers the part of the frame 4 most exposed to impacts, and a comb 60, also made from plastic, that outwardly covers a central part of the coating 62. In the example, the coating 62 and the comb 60 are both made from polyamide. The material of the coating 62 may, however, be different from that of the comb 60. As shown in FIG. 3, in the assembled configuration of the racket 2, the outer surfaces of the comb 60 and the coating 62, S60 and S62, respectively, are flush. Furthermore, the outer surface S62 of the coating 62 is flush with an outer edge C4 of the frame, such that the bumper 6 does not add an excess thickness relative to the frame 4.

The frame 4 also comprises, on each side, side housings 46 receiving through-bands 8 and 10 for the cross strings 5.2 of the lattice-work and, on its lower part, i.e., the part adjacent to the handle, a housing 48 receiving a through-band 12 of the main strings 5.1 of the lattice-work. A housing 46 receiving the band 10 is shown in FIG. 4, while the housing 48 is shown in FIG. 5. Each housing 46 or 48 extends peripherally on the outer part of the frame 4, i.e., on the part furthest from the lattice-work 5.

The through-bands 6 to 12 for the cord strands 5.1 or 5.2 of the lattice-work 5 are better known as grommets. They are made from plastic and are in the form of a comb. They each include tubes 16 that allow the passage of the ends 18 of the cord strands. The tubes 16 therefore each define a through-hole 14 in which an end 18 of a cord strand is inserted. The tubes 16 are inserted toward the inside of the frame 4, in through-holes 40 and 42 arranged in the frame 4. The tubes 16 protrude toward the inside of the frame 4 by a distance d smaller than 2.5 mm, and on average smaller than 1.7 mm, to minimize damage to the aerodynamic behavior of the racket 2, while preventing contact between the cord strands 5.1 and 5.2 of the lattice-work and the carbon frame 4. This distance d is measured parallel or perpendicular to the longitudinal direction of the main strings 5.1 along the considered tube 16. As shown in FIGS. 3 to 5, the distance d varies along the considered band. For example, the tubes 16 of the bands 8 and 10 protrude more toward the inside of the frame 4 than the tubes 16 of the band 12. For the apical cross-section, the tubes 16 belong to the comb 60. To that end, the coating 62 is provided with orifices O62 for the passage of the tubes 16.

The outer surfaces of the bands 8, 10 and 12 are each flush with the outer contour C4 of the cross-section of the frame 4. This is visible in FIGS. 4 and 5, for the bands 10 and 12, respectively.

Furthermore, as shown in FIG. 6, the through-holes 14 of the main strings, i.e., the holes 14 defined by the bands 6 and 12, are oblong. The term oblong here refers to a shape that is longer than it is wide, and the corners of which are rounded. The longest dimension of these oblong holes 14 is, in cross-section, parallel to the stringing plane, and perpendicular to the longitudinal axis X2. As shown in FIG. 6, the cords 18 therefore have axial play J inside the holes 14. Thus, the main strings 5.1 can move more easily in the transverse direction, which favors the effectiveness of the ball on the lattice-work. The outer edge of the tubes 16 is also oblong. The through-holes 40 and 42 for these tubes 16 have a complementary shape, such that the tubes 16 have no play inside the holes 40 and 42 of the frame 4.

According to another alternative that is not shown, each band has two parts.

According to another alternative that is not shown, the comb 60 and the coating 62 are in a single piece.

According to another alternative that is not shown, the bands 8 and/or 10 are in several separate parts.

The features of the alternatives and embodiments considered above may be combined with one another to create new embodiments of the invention.

The invention claimed is:

1. A tennis racket, comprising:

an oval frame that support a lattice-work, a lattice-work, supported by the frame, comprising strands of cords, through-bands of the strands of cords of the lattice-work, each through-band being received in an outer housing in the oval frame and comprising through-tubes for the strands, said through-tubes being inserted in a direction of an interior of the oval frame, in through-holes provided in the oval frame, wherein:

a through-band arranged at an apex of the racket consists of a coating and a comb covering a central part of the coating on a distal side on the coating with respect to the frame, each through-band is arranged flush with an outer edge of a cross-section of the oval frame, and an outer shell of the cross-section of the oval frame is essentially diamond-shaped.

2. The tennis racket according to claim 1, wherein the through-tubes protrude in the direction of the interior of the oval frame by a distance smaller than 2.5 mm.

3. The tennis racket according to claim 1, wherein a first part of the through-band arranged at the apex of the racket comprises an outer surface that is flush with an outer surface of a second part of the through-band arranged at the apex of the racket.

4. The tennis racket according to claim 1, wherein at least some of the through-tubes define oblong holes, inside which the strands of cord can move.

5. The tennis racket according to claim 4, wherein the strands of cord have main strings and cross strings, and wherein the through-tubes of the main strings define oblong holes, with the largest dimension of the oblong holes parallel to the plane of the lattice-work and perpendicular to the main strings.

6. The tennis racket according to claim 1, wherein the diamond shape of the outer shell of the cross-section of the frame is stretched in a direction perpendicular to the lattice-work.

7. A tennis racket, comprising:

an oval frame that support a lattice-work, a lattice-work, supported by the frame, comprising strands of cords, through-bands of the strands of cords of the lattice-work, each through-band being received in an outer housing in the oval frame and comprising through-tubes for the strands, said through-tubes being inserted in a direction of an interior of the oval frame, in through-holes provided in the oval frame, wherein:

a through-band arranged at an apex of the racket consists of a coating and a comb covering a central part of the coating on a distal side on the coating with respect to the frame, each through-band is arranged flush with an outer edge of a cross-section of the oval frame, wherein the through-tubes belong to the comb and wherein the coating defines through-orifices of the through-tubes, and an outer shell of the cross-section of the oval frame is essentially diamond-shaped.

8. The tennis racket according to claim 7, wherein the through-tubes protrude in the direction of the interior of the oval frame by a distance smaller than 2.5 mm.

9. The tennis racket according to claim 7, wherein a first part of the through-band arranged at the apex of the racket comprises an outer surface that is flush with an outer surface of a second part of the through-band arranged at the apex of the racket.

10. The tennis racket according to claim 7, wherein at least some of the through-tubes define oblong holes, inside which the strands of cord can move.

11. The tennis racket according to claim 10, wherein the strands of cord have main strings and cross strings, and wherein the through-tubes of the main strings define oblong holes, with the largest dimension of the oblong holes parallel to the plane of the lattice-work and perpendicular to the main strings.

12. The tennis racket according to claim 7, wherein the diamond shape of the outer shell of the cross-section of the frame is stretched in a direction perpendicular to the lattice-work.

* * * * *